US006029291A

United States Patent [19]

Livingston-Capoano

[11] Patent Number: 6,029,291

[45] Date of Patent: Feb. 29, 2000

[54] INTEGRATED FOOT SUPPORT FOR SHOWERS

[76] Inventor: Barbara Livingston-Capoano, 293 Squankum-Yellowbrook Rd., Howell, N.J. 07727

[21] Appl. No.: 09/174,964

[22] Filed: Oct. 19, 1998

[51] Int. Cl.[7] ..... A47K 3/12

[52] U.S. Cl. ..... 4/611; 004/574.1

[58] Field of Search ..... 4/574.1, 589, 604, 4/611, 614

[56] References Cited

U.S. PATENT DOCUMENTS 4,987,619 1/1991 Smith ..... 4/611 X 5,341,528 8/1994 Sultzbaugh ..... 4/611

FOREIGN PATENT DOCUMENTS 185391 7/1936 Switzerland ..... 4/611

*Primary Examiner*—Robert M. Fetsuga

*Attorney, Agent, or Firm*—Charles Brodsky

[57] ABSTRACT

A molded foot support integrally formed in the wall or corner of a shower assembly, the foot support extending outwardly from the wall or corner at a predetermined height having its edges molded to an arcuate shape and having a non-slip surface for support of the foot.

7 Claims, 4 Drawing Sheets

INTEGRATED FOOT SUPPORT FOR SHOWERS

BACKGROUND OF THE INVENTION

1. Field of the Invention

This invention relates to a foot support device to be integrally formed in the wall of a shower enclosure, which shower enclosure would normally be constructed of fiberglass and be of unitary construction.

2. Background of the Invention

While showering in a shower stall it is often times difficult for a woman to adequately shave her legs and to avoid nicking or cutting the skin. In order to accomplish this task, the individual must either bend over from the waist in a shower stall or be seated on a preformed seat formed in some shower stalls. Neither position is perfectly satisfactory for accomplishing the tasks since the smoothest shave is accomplished with the leg extended without any muscular contraction involved.

Attempts have been made in the past to develop foot supports for shower stalls to aid in the cleansing of the lower legs and feet. Many of these designs present safety problems within the shower assembly in that they protrude from the wall with sharp edges. Applicant identified these short comings in the development of a foot support in U.S. Pat. No. 5,228,151 for an after market item that could be installed to aid a woman in shaving her legs. In the interim period, U.S. Pat. No. 5,340,070 to Soma and U.S. Pat. No. 5,341,528 to Sultzbaugh have developed different versions of foot rest structures. All of the items heretofore, have been after market items and Applicant at this time proposes a foot rest to aid a woman in the shaving of her legs which would be integrally formed into the wall of a typical shower assembly as currently manufactured in one piece construction out of fiberglass or a similar construction material.

OBJECTS OF THE INVENTION

It is the principle object of the present invention to provide for a foot support for showers to facilitate the woman's act of shaving her legs.

It is another object of the present invention to provide for a foot support for showers which allows the woman to support her leg in a muscularly relaxed position.

It is still a further object of the present invention to provide for a foot support for showers which has no sharp or angled corners or edges.

It is still a further object of the present invention to provide for a foot support for the shower which can be integrally formed into the wall or corner of the shower and present a non-skid surface for the resting of the foot while shaving.

SUMMARY OF THE INVENTION

These and other objects of the present invention are achieved by means of a molded foot support integrally formed in the wall or corner of the shower when the shower is integrally formed of fiberglass-like material and is installed as a unit, the foot support extending outwardly from the wall or corner at a predetermined height and its edges molded into the flat portion of the wall, the foot contacting portion of the foot support having a slightly roughened surface to prevent slippage of the foot.

BRIEF DESCRIPTION OF THE DRAWINGS

These and other objects of the present invention will become more apparent in light of the following description and when taken in conjunction with the accompanying drawings wherein.

DETAILED DESCRIPTION OF THE DRAWINGS

Figure 1:
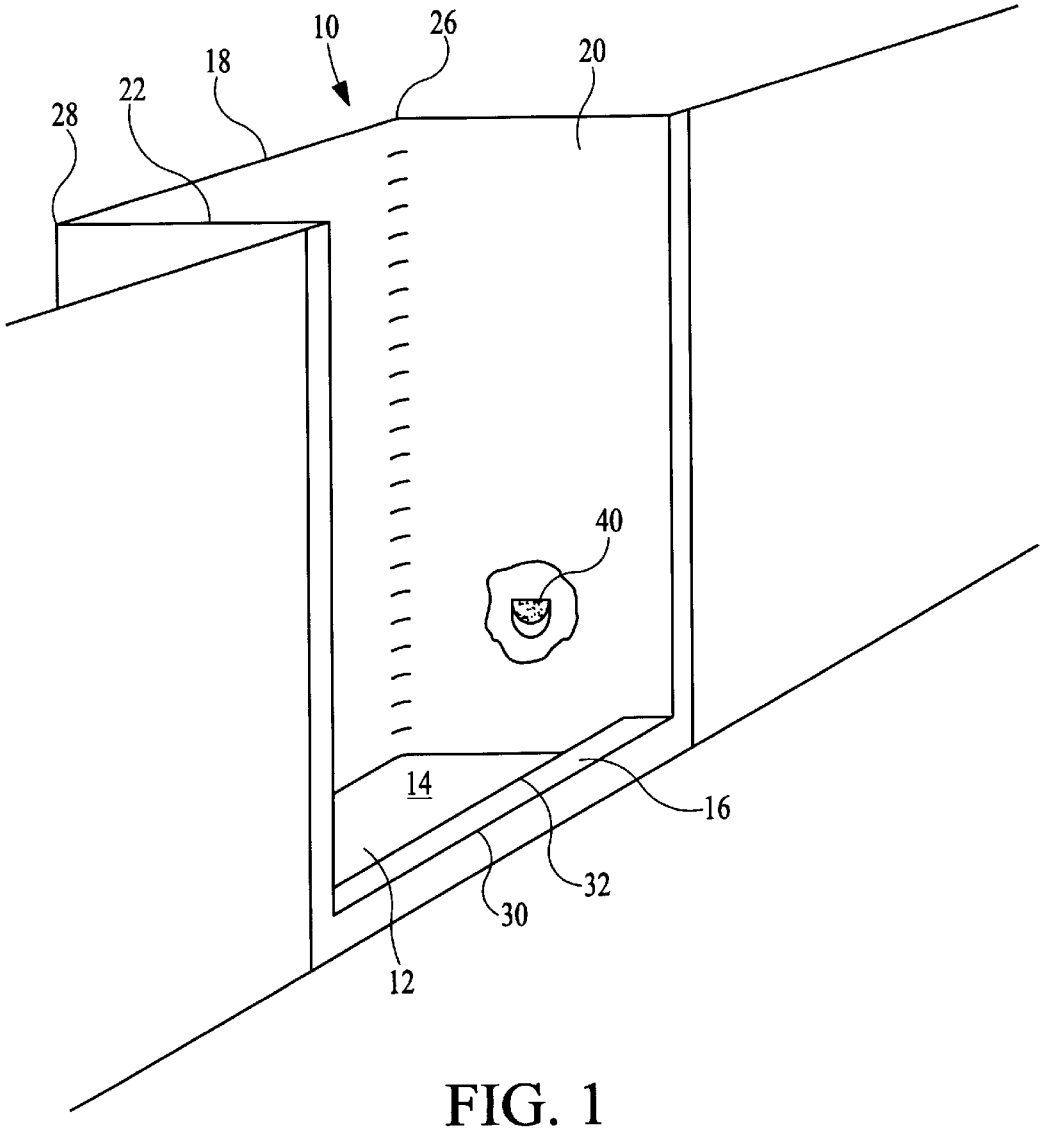
FIG. 1 is a perspective view identifying the positioning of the of support within a shower assembly.

FIG. 1 illustrates a typical unitary shower unit in an installed situation. In this perspective view which masks the faucet, shower head and the control knobs, the unit 10 itself is of one piece construction normally molded out of fiberglass or other suitable material. The molding process forms the tub portion 12, having a base 14 and front lip 16, a back wall 18, and end walls 20 and 22. The unit 10 is dimensioned and designed to fit into a preformed space defined by the framing of the bathroom. The corner 26 where end wall 20 and back wall 18 intersect, and the corner 28 where end wall 22 and back wall 18 intersect would normally be formed in the molding process to insure a rounded curvature as illustrated in FIG. 1. Similarly, the unit 10 is normally constructed with rounded edges where end walls 20 and 22 and back wall 18 intersect with the base 14 of tub portion 12. Similarly, the edges 30 and 32 of the front lip 16 are also rounded.

Applicant would seek to add to this molded one piece unit, a foot support for use by a woman when shaving her legs. In FIG. 1, this foot support is illustrated as being formed in end wall 20 at a predetermined height above the base 14 so as to allow the user to stand in the shower and support the foot of one leg on the foot support. The foot support 40 is shown as being formed in end wall 20, however, the foot support 40 could just as easily be formed in back wall 18 or in end wall 22 as long as it did not interfere with the faucet and control knobs, or at the intersection of alternatively in the corner at the intersection of end wall 20 and back wall 18 or end wall 22 and back wall 18.

Figure 2:
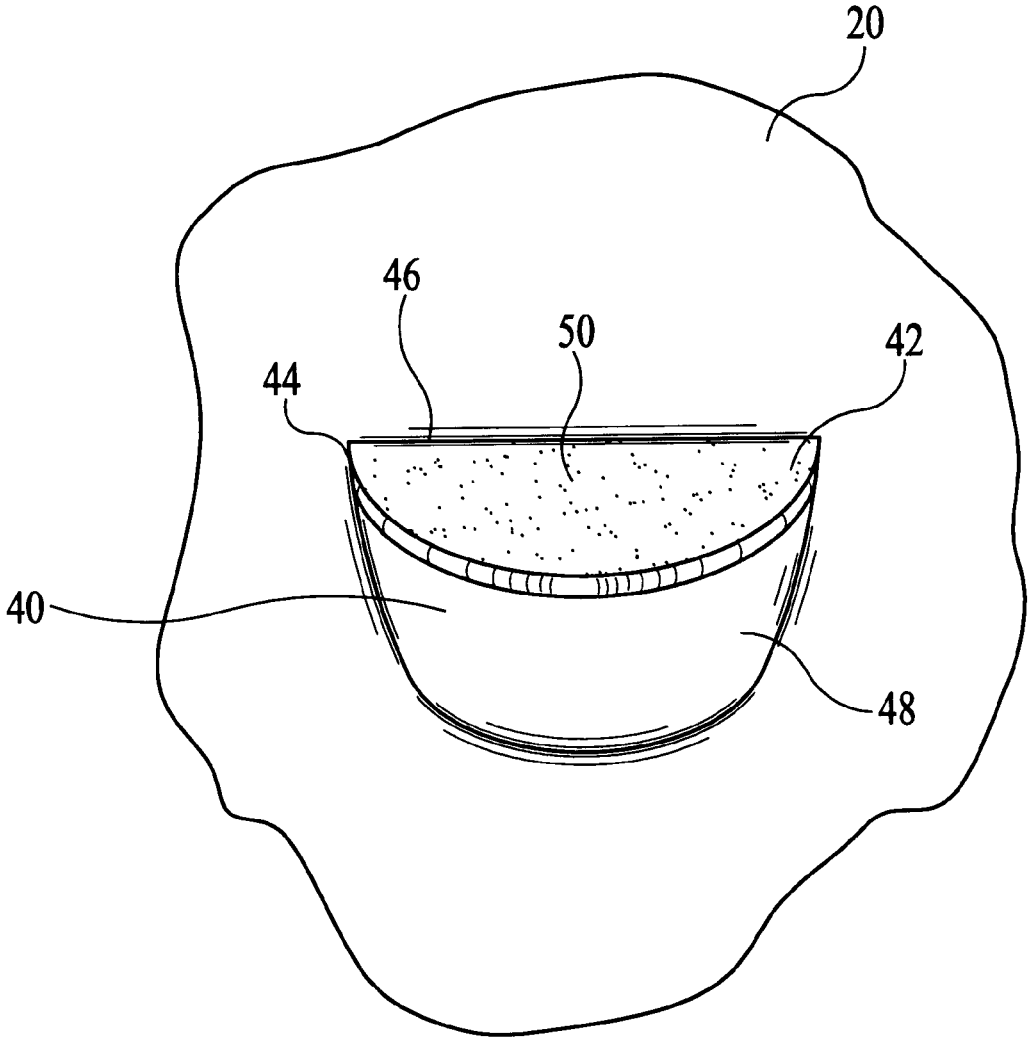
FIG. 2 is a front view of the foot support in a shower assembly.
Figure 3:
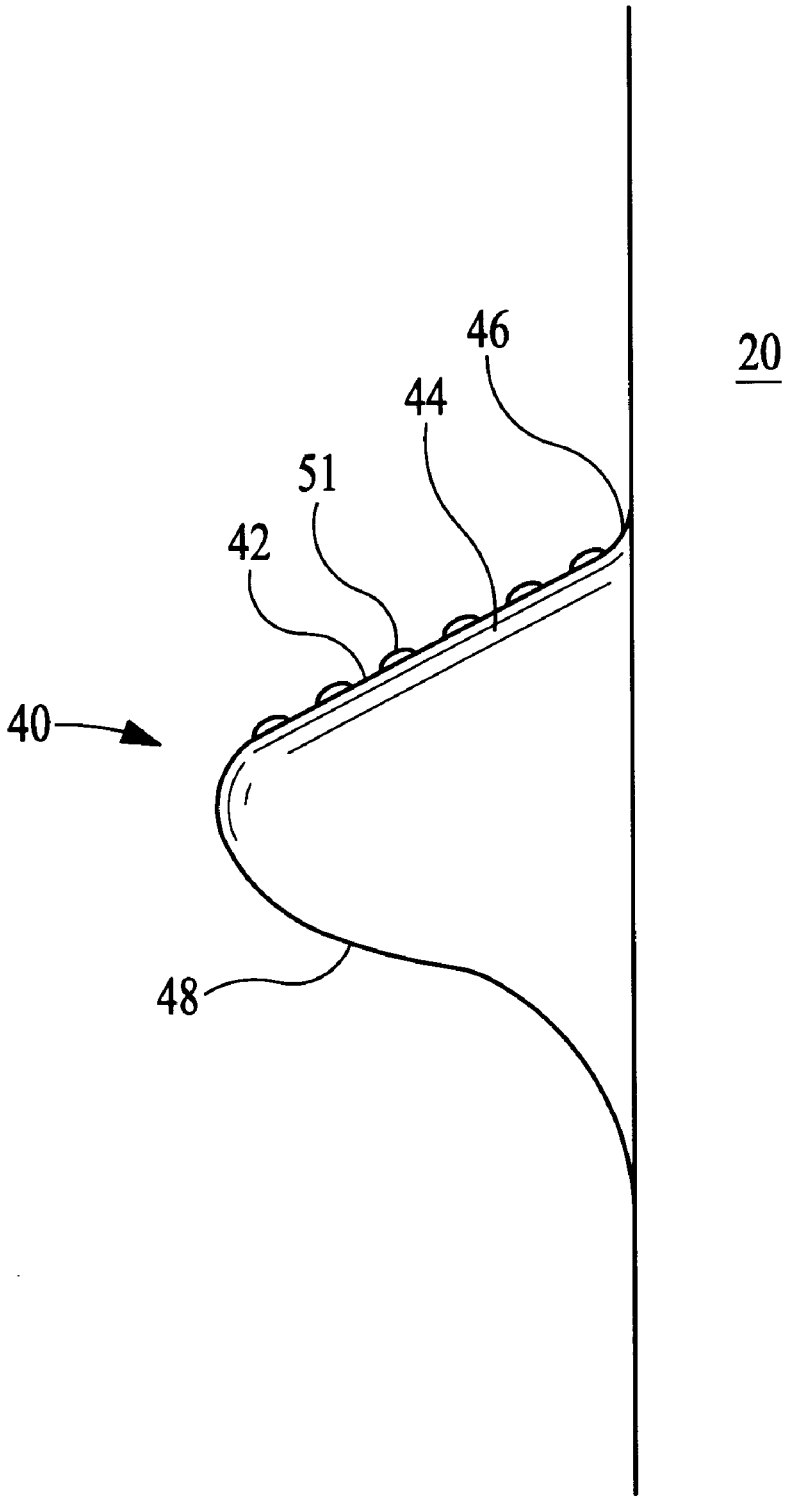
FIG. 3 is a side view of the foot support within a shower assembly.

FIG. 2 is a front view of the foot rest 40 in the area identified in FIG. 1 and FIG. 3 is a side view of the foot rest of FIG. 2. FIG. 2 is a front view of the foot support 40 illustrating its molded integration with end wall 20. Foot support 40 comprises a generally planar upper surface 42 which as illustrated in FIG. 3, is generally angled downwardly. Upper surface 42 is defined by an arcuate periphery 44 which is also rounded with respect to the upper surface 42 to eliminate any sharp edges. In molding the foot support from the end wall 20, the line of demarcation 46 with the end wall is also arcuate in nature. The side wall 48 is generally arcuate in a horizontal plane and also in the vertical plane such that side wall 48 blends or merges into end wall 20 so as to present no sharp edges or hidden crevices which would accumulate dirt or soap contaminants.

Upper surface 42 would preferably be irregular so as to present a non-skid surface to the foot while it was resting on upper surface 42. This irregularity may include a granulated surface 50 as illustrated in FIG. 2 or preformed beads 51 as illustrated in FIG. 3.

Figure 4:
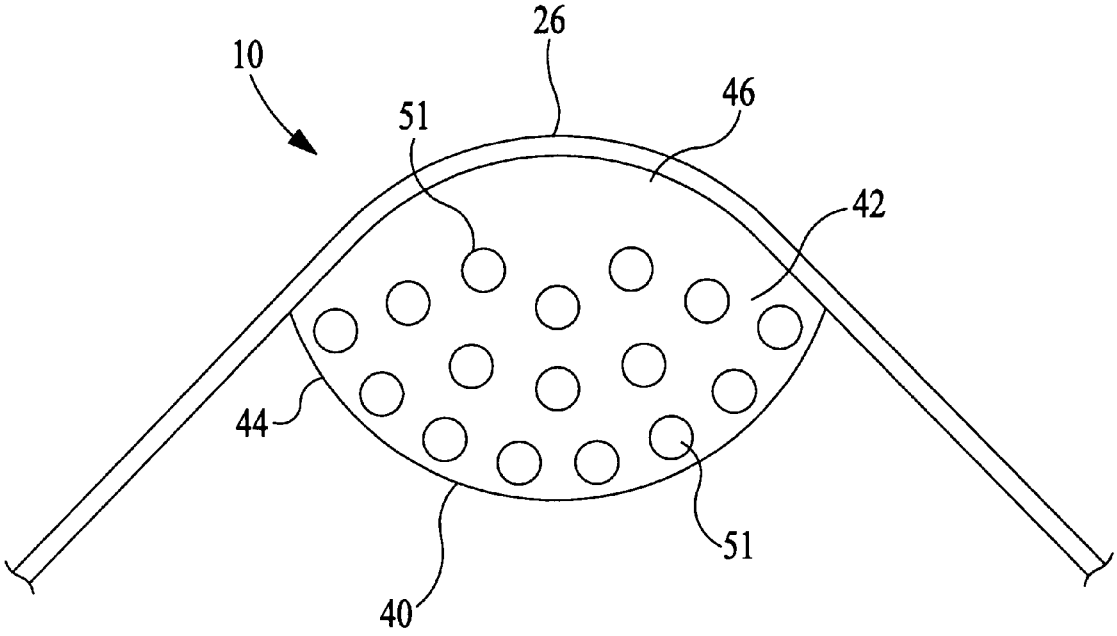
FIG. 4 is a top view of a second embodiment of the foot support within a shower assembly.

FIG. 4 is a top view along corner 26 of the unit 10 illustrating foot rest 40 in a molded configuration positioned in corner 26. In this configuration, the foot support 40 is substantially identical to the foot support when positioned on an end wall or back wall of the shower with the exception that the line of demarcation 46 between the foot support 40 and the end wall is now arcuate in shape since it encompasses a side wall, the back wall, and the corner of the shower. FIG. 4 further illustrates the second embodiment of the non-skid surface 42 as having a plurality of bead-like members 51 protruding upwardly from surface 42.

While the invention has been described in connection with an exemplary embodiment thereof, it will be understood that many modifications will be apparent to those of ordinary skill in the art; and that this application is intended to cover any adaptations or variations thereof. Therefore, it is manifestly intended that this invention be only limited by the claims and the equivalents thereof.

I claim:

1. A foot support apparatus for unitary showers to facilitate the shaving of the leg, comprising:

a shower assembly of unitary construction having a partially enclosed tub or basin portion defined by three integral walls, with said walls forming with said tub or basin portion two end walls and a back wall of said assembly;

and a foot support preformed in one of said integral walls, said foot support having a forwardly extending, downwardly inclined planar upper surface for engagement with the foot and support of the leg of an individual and a rearwardly extending lower surface arcuate in horizontal and vertical planes, with said foot support being positioned at a height above said tub or basin portion to facilitate the shaving of said leg of the individual, with said foot support having an arcuate periphery and rounded edges, and with said foot support being integrally molded into said shower assembly with arcuate lines of demarcation between said assembly and said upper and lower surfaces of said foot support.

2. The foot support apparatus in accordance with claim 1 wherein said foot support is integrally molded into one of said end walls of said shower assembly.

3. The foot support apparatus in accordance with claim 1 wherein said foot support is integrally molded into said back wall of said shower assembly.

4. The foot support apparatus in accordance with claim 1 wherein said foot support is integrally molded along a corner defined by an intersection of one of said end walls with said back wall.

5. The foot support apparatus in accordance with claim 1 wherein said foot support upper surface includes a granulated surface.

6. The foot support apparatus in accordance with claim 1 wherein said foot support upper surface includes a plurality of protruding beads.

7. The foot support apparatus in accordance with claim 1 wherein said foot support surface exhibits an irregular non-skid characteristic to limit slippage of a foot placed thereon.

* * * * *